United States Patent [19]

Sanders et al.

[11] Patent Number: 4,765,842

[45] Date of Patent: Aug. 23, 1988

[54] TICKET CLEANER APPARATUS

[76] Inventors: Charles R. Sanders, 2737 Leisure Dr., Ft. Collins, Colo. 80525; James L. Sattler, 5915 Neptune Dr., Ft. Collins, Colo. 80526

[21] Appl. No.: 923,767

[22] Filed: Oct. 27, 1986

[51] Int. Cl.[4] ..... A46B 13/02

[52] U.S. Cl. ..... 134/9; 15/21 D; 15/77

[58] Field of Search ..... 15/77, 102, 38, 39, 15/21 D, 34, 74; 134/6, 9

[56] References Cited

U.S. PATENT DOCUMENTS

| | | | |
|---|---|---|---|
| 235,328 | 12/1880 | Zimmerman | 15/77 |
| 325,916 | 9/1885 | Daniels, Jr. | 15/77 |
| 3,117,333 | 1/1964 | Murray et al. | 15/77 X |
| 3,242,517 | 3/1966 | Buros et al. | 15/77 |
| 3,805,318 | 4/1974 | Marquette | 15/39 |
| 4,006,507 | 2/1977 | Yoshida | 15/102 |
| 4,107,807 | 8/1978 | Nash, Jr. | 15/77 |

*Primary Examiner*—Edward L. Roberts
*Attorney, Agent, or Firm*—Dean P. Edmundson

[57] ABSTRACT

Ticket cleaner apparatus is described which is adapted to remove a coating from the surface of a game ticket to reveal or expose characters on the ticket. The apparatus includes: (a) a housing which includes an opening to receive the ticket; (b) a rotatable cleaning element supported within the housing; (c) positioning means adapted to position the ticket within the housing so that the coating on the ticket is in contact with the cleaning element; and (d) power means which is adapted to rotate the cleaning element while in contact with the coating on the ticket.

13 Claims, 3 Drawing Sheets

TICKET CLEANER APPARATUS

FIELD OF THE INVENTION

This invention relates to cleaning devices. More particularly, this invention relates to techniques and apparatus for cleaning coatings off of surfaces. Even more particularly, this invention relates to techniques and apparatus for cleaning coatings off the surface of tickets (e.g., lottery tickets) and game cards.

BACKGROUND OF THE INVENTION

Lottery games have become extremely popular in recent years. Numerous states now have lottery games of one type or another and literally millions of lottery tickets are sold to the general public every year.

Typically a lottery ticket comprises a card on which there are printed numbers, letters, symbols, or some combination of characters which determine whether the purchaser of a particular card or ticket is entitled to a prize. The printed characters on the card are covered or hidden by an opaque coating or layer which is removable from the surface of the card or ticket by scraping or rubbing to reveal or expose the printed characters.

The coating on the card or ticket may be composed of various materials so long as the coating is visually opaque and relatively easy to remove with scraping or abrasion. Typically, a common type of coating used on such tickets comprises a blend of graphite particles and a wax (e.g., paraffin).

Similar types of tickets are also used, for example, by some grocery stores, drug stores, variety stores, etc. for their own types of games. For example, they may be used in games for giving away merchandise or other prizes.

Tickets of the type described herein are sold in various business establishments, typically at the check-out register, counter, bar, etc. Often times the purchaser or recipient of a ticket immediately scrapes or rubs the coating off the ticket while standing at the check-out register or counter. Naturally this takes time and causes delays in the check-out line.

The purchasers of the tickets normally use the edge of a coin to remove the coating to reveal the printed characters on the ticket. The coating shavings or fragments which result from scraping of a ticket are unsightly and can soil hands and clothing. Thus, it is undesirable for the shavings or fragments to be left on counters, tables, bar tops, etc.

There has not heretofore been provided a convenient, clean, and effective means for removing the coating from lottery or game tickets.

SUMMARY OF THE PRESENT INVENTION

In accordance with the present invention there is provided ticket cleaner apparatus which is adapted to quickly and efficiently remove the coating from the surface of a game ticket (e.g., a lottery ticket or the like) to reveal or expose characters on the ticket.

The apparatus of the invention comprises:

(a) a housing which includes an opening therein which is adapted to receive the ticket to be cleaned;

(b) a rotatable cleaning element supported in the housing;

(c) positioning means adapted to position the ticket within the housing in a manner such that the coating on the ticket is in contact with the cleaning element; and (d) power means which is adapted to rotate the cleaning element while in contact with the coating.

When the ticket is inserted through the opening in the housing, the rotatable cleaning element removes the coating from the surface of the ticket to reveal the characters which are printed on the ticket. The apparatus gently removes the coating without damaging the ticket itself.

The ticket cleaner of this invention is very useful, for example, at check-out registers, check-out counters, etc. so that the purchasers of such game tickets can quickly determine whether they have won a prize. Use of this apparatus eliminates the need for the purchaser to search for an appropriate coin, fingernail file, etc. to scrape off the coating on the ticket.

As a result, use of the apparatus of this invention expedites check-out procedures and prevents the scraped coatings from soiling hands or clothing or cluttering the counters. The ticket cleaner apparatus is also very useful when it is necessary to clean the coating off of unsold game tickets for auditing purposes. Thus, large numbers of game tickets can be quickly and efficiently cleaned using this apparatus without harming the ticket and without creating a mess from the scraped off coatings.

Other advantages of the apparatus of this invention will be apparent from the following description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
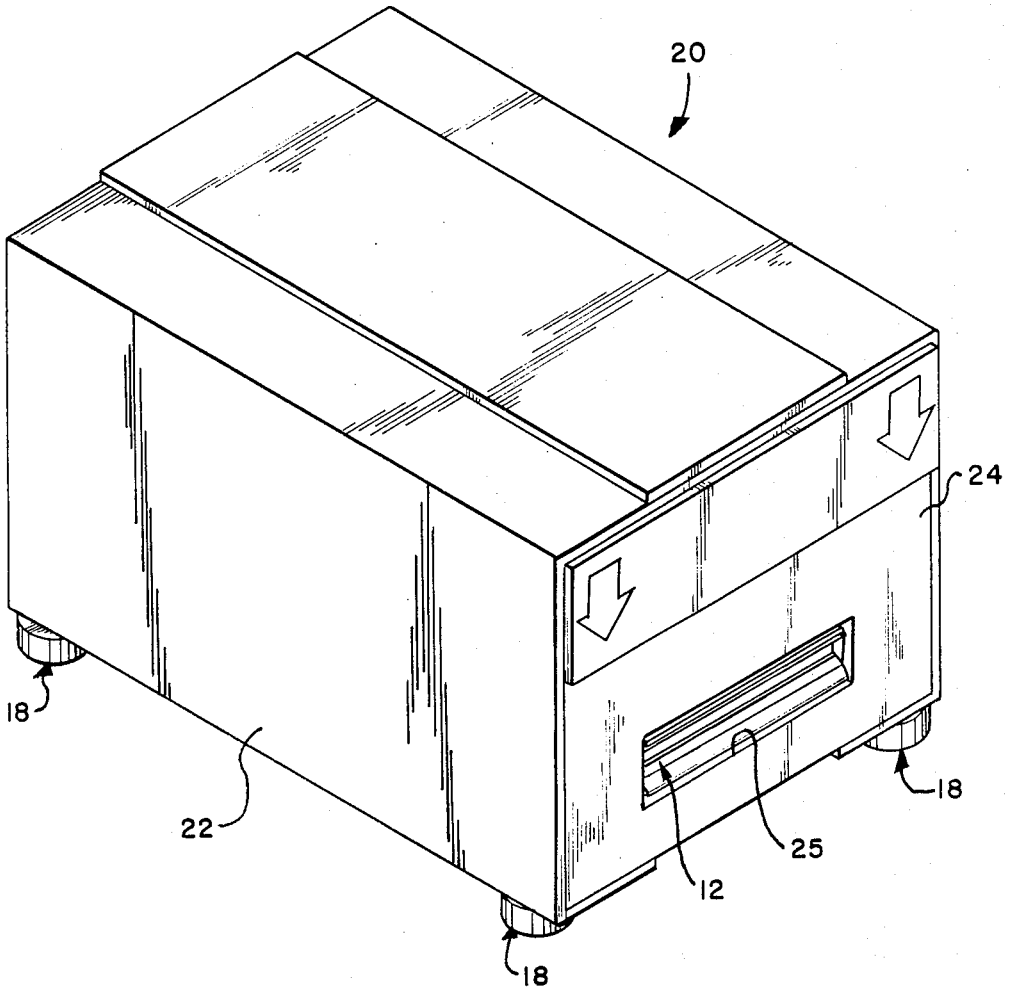
FIG. 1 is a perspective view of one embodiment of ticket cleaning apparatus of the invention.
Figure 5:
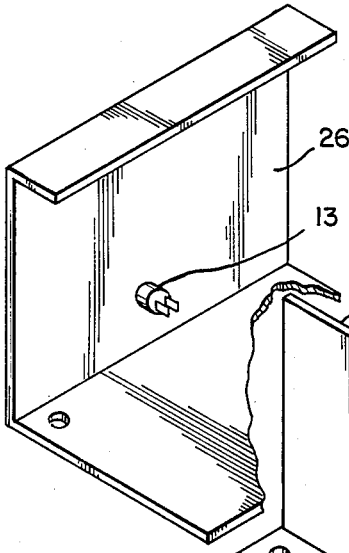
FIG. 5 is a perspective view of the rear portion of the housing for the apparatus shown in FIG. 1.

In the accompanying drawings there is illustrated one embodiment of ticket cleaning apparatus 20 of the invention. The apparatus includes an outer housing comprising main body portion 22, front end portion 24, and rear end portion 26. Front portion 24 includes a slotted aperture or opening 25 through which a game ticket to be cleaned may be inserted, as explained in more detail hereafter.

Figure 6:
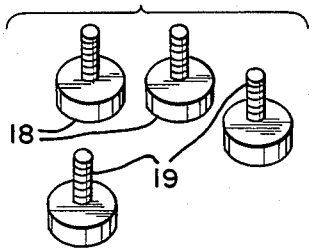
FIG. 6 shows the rubber feet which are preferably attached to the bottom of the ticket cleaner shown in FIG. 1.

Feet members 18 having threaded shanks 19 are illustrated in FIG. 6. The shanks 19 of the feet members are adapted to secure the housing portions to upright members 7 and 8, i.e. the shank 19 is adapted to extend upwardly through an opening 22*a* in housing portion 22, then through opening 24*a* in end portion 24, and then through opening 8*a* in upright member 8. Preferably opening 8*a* in upright 8 is threaded so that shank 19 is secured therein without the need for a nut or fastener. Similarly, the shank 19 of another foot member passes through registering openings in housing portion 22, end portion 26 and upright 8. In similar fashion the other two feet members secure the other side of the housing portions to upright member 7. Preferably, the pad or lower end of each foot member comprises rubber or other non-skid material.

Figure 10:
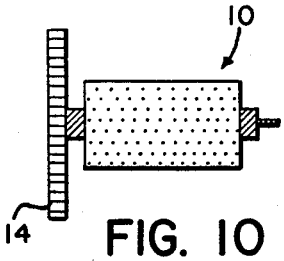
FIG. 10 is an elevational view of one embodiment of cleaning element used in the invention.

Between the upright support members 7 and 8 there is supported a rotatable cleaning element 10. This is also illustrated in FIG. 10. Preferably cleaning element 10 comprises a cylindrical roll which is mounted transversely with respect to the longitudinal center line of the apparatus 20.

A toothed gear member 14 is secured to one end of the cleaning element. The gear member is fastened to the cleaning element such that rotation of the gear member causes rotation of the cleaning element.

Figure 11:
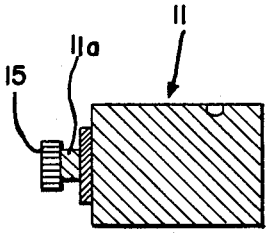
FIG. 11 is an elevational view of one embodiment of motor used in the invention.

An electric motor 11 is also supported between the upright members 7 and 8. A toothed gear member 15 is fastened to the output shaft 11*a* of the motor (as illustrated in FIG. 11). Gear member 15 is adapted to engage gear member 14 and thereby drive cleaning element 10 in a rotating manner.

The electric motor 11 may be powered by A.C. or D.C. current. For example, it may be powered by a D.C. battery, or it may be powered by A.C. current which has been converted to D.C. current through an appropriate adaptor 13.

Figure 7:
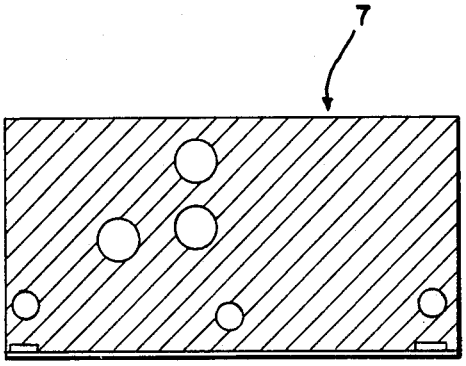
FIGS. 7 and 8 are elevational views illustrating the upright supports for the working parts of the apparatus of FIG. 1.
Figure 8:
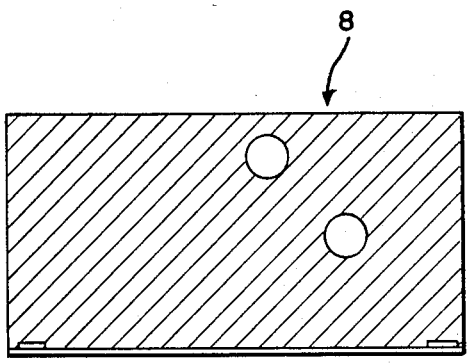

FIG. 7 is an elevational view of upright support 7. The various openings which are visible in this view are for mounting the motor, cleaning element, and micro-switch as well as for passage of electrical wires to the motor and micro-switch. FIG. 8 is an elevational view of upright support 8. The two openings which are visible in the plate are for mounting of the motor and the cleaning element.

Figure 12:
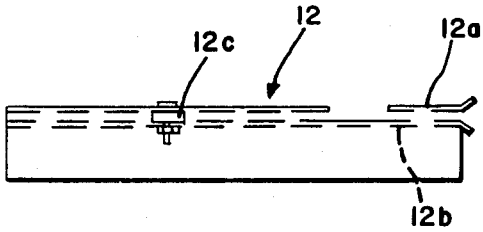
FIG. 12 is a side elevational view illustrating guide means for the ticket to be inserted into the apparatus.
Figure 13:
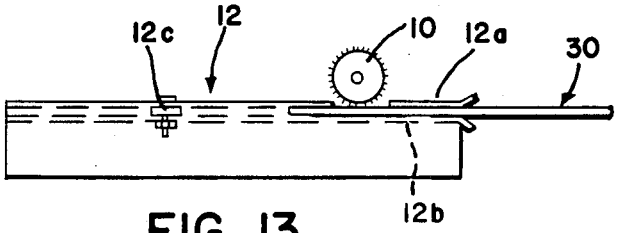
FIG. 13 is a side elevational view illustrating one manner in which the cleaning element removes the coating from a game ticket.

The ticket guide or positioning assembly 12 is illustrated in the elevational views of FIGS. 12 and 13. The leading end of the assembly is also visible in FIG. 4. Basically the guide assembly includes horizontal plate members 12*a* and 12*b* which are spaced-apart and parallel to each other. The spacing between the plates is preferably only slightly greater than the thickness of the game ticket 30 to be cleaned. The leading or front ends of the plates are flared away from each other to facilitate sliding entry of the ticket 30 between the plates as illustrated in FIG. 13. Stop member 12*c* serves as an effective limit to the extent or distance which the ticket may be inserted into the apparatus.

As illustrated in FIG. 13, the periphery of the cleaning element 10 contacts the upper surface of ticket 30, and the rotation of the cleaning element causes the coating on the upper surface of the ticket to be scraped or abraded away, thereby revealing the printed characters on the upper surface of the ticket. The guide of positioning assembly 12 assures that the ticket 30 is maintained in proper position relative to the periphery of the cleaning element 10 as the ticket is inserted into the apparatus.

The pressure of the cleaning element against the upper surface of the ticket is such that the coating on the ticket is scraped or abraded away without causing physical damage to the characters or symbols printed on the ticket itself.

Figure 4:
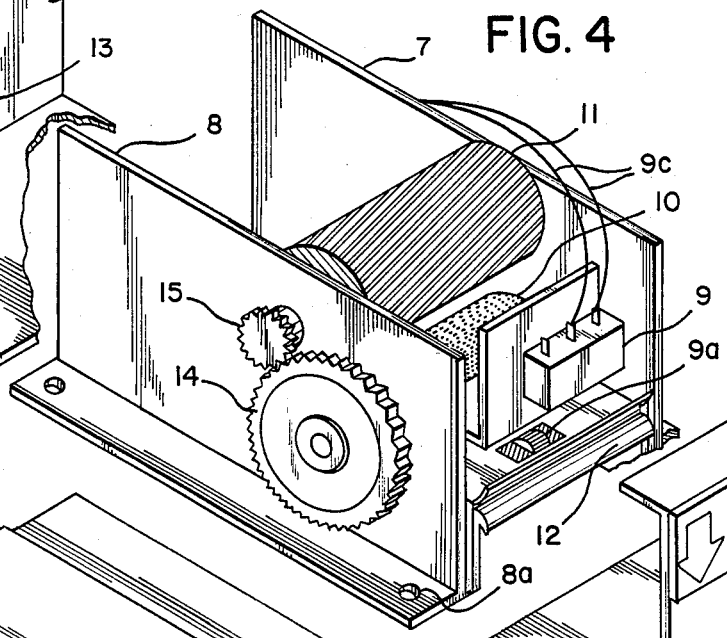
FIG. 4 is a perspective view illustrating the working parts of the apparatus shown in FIG. 1.
Figure 3:
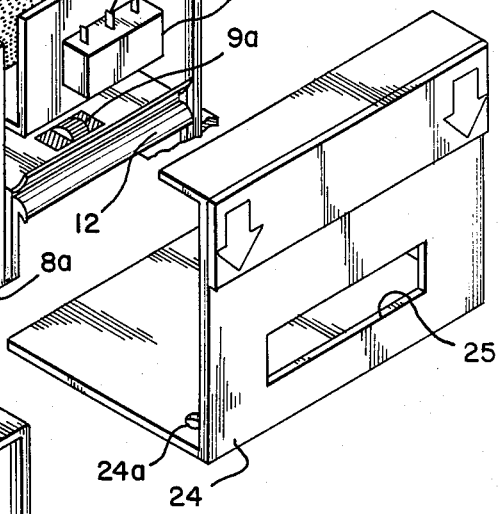
FIG. 3 is a perspective view of the front portion of the housing for the apparatus shown in FIG. 1.
Figure 2:
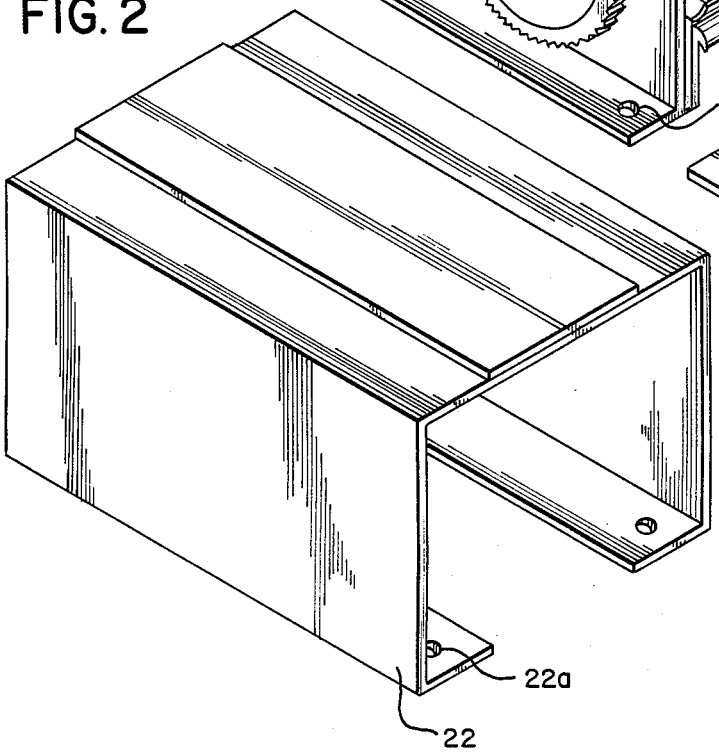
FIG. 2 is a perspective view of the main body of the housing for the apparatus shown in FIG. 1.
Figure 9:
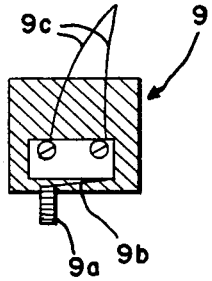
FIG. 9 is an elevational view of a micro-switch which is preferably used in the apparatus of the invention.

Preferably a micro-switch 9, having roller activator 9*a*, is positioned near the leading end of guide assembly 12 as illustrated in FIG. 4. As the ticket is inserted into the guide assembly the ticket urges roller 9*a* upwardly to close the switch. This then activates the motor 11 to begin rotation of cleaning element 10. When the ticket has been cleaned and is withdrawn from the guide assembly, the roller 9*a* is urged downwardly by spring 9*b* (shown in FIG. 9) so that the micro-switch opens and the motor stops. The micro-switch is connected between the motor 11 and the power source. Wires 9*c* which are visible in the drawings connect between the micro-switch and the power source.

The cleaning element preferably includes brush means on its periphery. The brush means may be composed of various types of materials, such as hair bristles (e.g., horse hair), plastic (e.g., nylon), or metal bristles (e.g., brass, steel, etc.). Other equivalent materials, or combinations of materials, may also be used, if desired.

Other variants are possible without departing from the scope of this invention. For example, the power means may be a hand operated crank instead of an electric motor. Also, more than one cleaning element may be used, if desired. It is also possible to use an endless belt for the cleaning element instead of a roll.

What is claimed is:

1. Ticket cleaner apparatus adapted to remove a coating from the surface of a game ticket to reveal characters on said ticket, said apparatus comprising:

(a) a housing which includes an opening therein which is adapted to receive said ticket;

(b) a rotatable cleaning element supported within said housing; said element comprising a cylindrical roll having brush means on the periphery thereof;

(c) positioning means adapted to position said ticket within said housing in a manner such that said coating on said ticket is in contact with said cleaning element; wherein said positioning means comprises spaced-apart parallel plates; wherein one said plate includes an opening enabling said periphery of said cleaning element to project therethrough to contact said coating when said ticket is inserted between said parallel plates;

(d) power means which is adapted to rotate said cleaning element while in contact with said coating; and (e) switch means operably connected to said power means in a manner such that said power means becomes activated to drive said cleaning element when said ticket is inserted between said parallel plates;

wherein said cleaning element is adapted to remove portions of said coating from said ticket to reveal said characters.

2. Ticket cleaner apparatus in accordance with claim 1, wherein said power means comprises an electric motor.

3. Ticket cleaner apparatus in accordance with claim 2, wherein said motor is adapted to be powered by a battery contained within said housing.

4. Ticket cleaner apparatus in accordance with claim 1, wherein said brush means comprises hair.

5. Ticket cleaner apparatus in accordance with claim 1, wherein said brush means comprises plastic.

6. Ticket cleaner apparatus in accordance with claim 1, wherein said brush means comprises metal bristles.

7. Ticket cleaner apparatus adapted to remove a coating from the surface of a game ticket to reveal characters on said ticket, said apparatus comprising:

(a) a housing which includes an opening therein which is adapted to receive said ticket;

(b) a rotatable cleaning element supported within said housing, said element comprising a cylindrical roll having brush means on the periphery thereof;

(c) positioning means adapted to position said ticket within said housing in a manner such that said coating on said ticket is in contact with said roll; wherein said positioning means comprises spaced-apart parallel plates; wherein one said plate includes an opening enabling said periphery of said cleaning element to project therethrough to contact said coating when said ticket is inserted between said parallel plates;

(d) electric motor means within said housing which is adapted to rotate said roll while in contact with said coating; and (e) switch means operably connected to said electric motor in a manner such that said motor becomes activated to drive said cleaning element when said ticket is inserted between said parallel plates;

wherein said roll is adapted to remove portions of said coating from said ticket to reveal said characters.

8. Ticket cleaner apparatus in accordance with claim 7, wherein said motor means is adapted to be powered by a battery contained within said housing.

9. Ticket cleaner apparatus in accordance with claim 7, wherein said brush means comprises hair.

10. Ticket cleaner apparatus in accordance with claim 7, wherein said brush means comprises plastic.

11. Ticket cleaner apparatus in accordance with claim 7, wherein said brush means comprises metal bristles.

12. Ticket cleaner apparatus in accordance with claim 7, wherein said switch means comprises a microswitch.

13. A method for removing a coating from the surface of a game ticket to reveal characters on said ticket, said method comprising the steps of:

(a) providing apparatus in accordance with claim 1;

(b) inserting said ticket into said opening in said housing in a manner such that periphery of said cylindrical roll contacts said surface of said ticket to remove said coating and reveal said characters on said ticket.

* * * * *